United States Patent [19]

Swarte

[11] Patent Number: 4,712,247

[45] Date of Patent: Dec. 8, 1987

[54] ELECTRO-ACOUSTIC SYSTEM HAVING A VARIABLE REFLECTION/ABSORPTION CHARACTERISTIC

[75] Inventor: Petrus A. Swarte, Breda, Netherlands

[73] Assignee: U.S. Philips Corporation, New York, N.Y.

[21] Appl. No.: 716,774

[22] Filed: Mar. 27, 1985

[30] Foreign Application Priority Data

Apr. 3, 1984 [NL] Netherlands ..... 8401041

[51] Int. Cl.[4] ..... H04R 3/00

[52] U.S. Cl. ..... 381/96; 381/59; 381/105

[58] Field of Search ..... 381/66, 96, 59, 71, 381/94, 102, 105

[56] References Cited

U.S. PATENT DOCUMENTS

| | | | |
|---|---|---|---|
| 3,647,969 | 3/1972 | Korn | 381/96 |
| 3,872,247 | 3/1975 | Saville et al. | 381/96 |
| 4,387,270 | 6/1983 | Sakano et al. | 381/96 |

FOREIGN PATENT DOCUMENTS

| | | | |
|---|---|---|---|
| 2235664 | 1/1974 | Fed. Rep. of Germany | 381/96 |
| 2420689 | 11/1975 | Fed. Rep. of Germany | 381/96 |
| 159196 | 10/1982 | Japan | 381/96 |
| 0862393 | 9/1981 | U.S.S.R. | 381/96 |

*Primary Examiner*—Forester W. Isen

*Attorney, Agent, or Firm*—Robert T. Mayer; Bernard Franzblau

[57] ABSTRACT

An electro-acoustic arrangement comprises an amplifier (4) having a first input terminal (5), a second input terminal (5'), a first output terminal (3), a second output terminal (3'), and a series arrangement of a first impedance (1) and an electro-acoustic transducer unit (2) is coupled to the output terminals (3, 3'). At least the first impedance (1) is also coupled to the input terminals (5, 5') of the amplifier. The gain factor (A) of the amplifier for a signal applied to the first and second input terminals (5) and/or the impedance value $Z_1$ of the first impedance may be variable. This arrangement influences the acoustic properties of a space, such as the reverberation time. By means of such an arrangement (FIG. 1) and in particular by means of a system (FIG. 9) comprising a plurality of such arrangements, the acoustic properties of a space, such as the reverberation time, can be influenced.

23 Claims, 12 Drawing Figures

ELECTRO-ACOUSTIC SYSTEM HAVING A VARIABLE REFLECTION/ABSORPTION CHARACTERISTIC

BACKGROUND OF THE INVENTION

This invention relates to an electro-acoustic arrangement comprising an electro-acoustic transducer unit coupled to an amplifier for influencing the acoustic properties of a space.

The invention also relates to an electro-acoustic system for influencing the acoustic properties of a space (e.g. an auditorium) which comprises a plurality of electro-acoustic arrangements. An electro-acoustic arrangement of the type defined in the opening paragraph is known from U.S. Pat. No. 3,392,240.

The known arrangements comprise a microphone which is coupled to a loudspeaker via the amplifier. The microphone is situated in a space at the location of an antinode of a standing wave in the space and the loudspeaker is also situated at the location of an antinode of the same standing wave in the space. The arrangement comprises a filter by which it is tuned to the natural frequency of the standing wave. By arranging a plurality of arrangements for different standing waves in the space it is possible to vary or alter the acoustic properties, in particular the reverberation time, of the space.

SUMMARY OF THE INVENTION

The known arrangements have the drawback that in general their performance is poor and it is very expensive to realize such an arrangement or a system comprising a plurality of such arrangements. The invention aims at providing cheaper arrangements with an improved performance, their construction being such that it is simpler and cheaper to install a plurality of arrangements in a system. According to the invention, the arrangement is characterized in that the arrangement further comprises a first impedance arranged in series with the transducer unit. This series arrangement is coupled to a first output terminal and a second output terminal of the amplifier, and at least the first impedance is also coupled between a first input terminal and a second input terminal of the amplifier. Preferably, the arrangement in accordance with the invention is characterized in that the impedance value of the first impedance and/or the gain factor of the amplifier for the signal applied to the first input terminal and the second input terminal and delivered to the first output terminal and the second output terminal is variable. In the known arrangements the microphone and the loudspeaker must be positioned fairly accurately at the location of the antinodes of a standing wave in order to obtain a satisfactory operation of the system. As a result of changes in the physical parameters, for example the temperature in the space or the presence of an audience in the space, the waveforms and positions of the standing waves may vary in such a way that the microphone and the loudspeaker of the known arrangements are no longer situated at the correct location of the antinodes of the associated standing wave. The known arrangements are then no longer capable of amplifying the standing wave to a satisfactory extent.

The arrangements in accordance with the invention are not directly tied to a specific location in the space and may be arranged at a more or less arbitrary location in the space without their acoustic performance being impaired. The arrangement in accordance with the invention operates as follows.

By means of the first impedance and the amplifier the acoustic behaviour of the transducer unit can be influenced in such a way that, depending on the desired operation of the transducer unit, the acoustic waves which are incident on the transducer unit "see" a desired acoustic impedance. If the transducer unit is intended to provide total absorption of the incident acoustic waves the acoustic waves "see" an acoustic impedance corresponding to the characteristic wave impedance of the medium.

If the transducer unit is intended to provide total reflection of the waves the acoustic waves "see" an acoustic impedance which differs from the above impedance. This is because impedance mismatching, as is known, gives rise to reflections.

Thus, the acoustic behaviour of the transducer unit can be influenced by selecting a certain value for the impedance value of the first impedance and for the gain factor of the amplifier.

When the value of the first impedance and/or the gain factor of the amplifier for the signal applied to the first input terminal and the second input terminal and taken from the first output terminal and the second output terminal are adjusted to a specific value, the transducer unit can operate as a reflector or as an absorber for the acoustic waves which are incident on the transducer unit. The transducer unit then operates both as a loudspeaker and as a microphone. The acoustic waves which are incident on the transducer unit produce an electric current through and a voltage across the first impedance. In the amplifier this voltage is amplified and applied to the transducer unit. If the transducer unit is required to provide total reflection the excursion of the diaphragm of the transducer unit as a result of the incident acoustic waves is counteracted, so that the diaphragm does not (or hardly) move. If the transducer unit is required to provide total absorption the excursion of the diaphragm as a result of the incident acoustic waves is amplified in such a way that the diaphragm exactly follows (the amplitude and the phase of) the acoustic waves, so that the acoustic waves do not "see" the transducer unit (the acoustic wave is terminated exactly with its acoustic impedance). By selecting different values for the first impedance and/or the gain factor different absorption values and coefficients (between 0 and 100%) can be obtained.

If such an arrangement (or a plurality of such arrangements) are arranged in or near a wall of a space, this enables the reflection and absorption coefficients of the walls of the space and hence the reverberation time of the space to be adapted as desired. It is obvious that the acoustic properties of the space can also be influenced if the device is arranged at another location in the space. In particular, if the said value(s) is/are variable, the reverberation time of the space can thus be influenced very simply. As the arrangements can be compact, the signal leads may be short. Moreover, installing such a compact arrangement is comparatively simple. Further, the arrangements are not tied to a specific location if a control of only the reverberation time is desired. If the variation of the transmission between two points in a space via reflectors should be realized, it will be clear that these reflectors are tied to their specific location. In general, however, the arrangement is simpler and easier to realize, inter alia because in principle only one transducer unit is required, which unit functions both as a microphone and as a loudspeaker. Moreover, the cabling is simplified so that a system comprising a plurality of these arrangement can also be cheaper.

The transducer unit need not always be a conventional (moving-coil or cone) loudspeaker. It is possible to construct a transducer unit, for example, by using a panel (in the wall of the space) as a diaphragm and securing this panel to the voice-coil former of a conventional magnet system. Moreover, transducer units other than electrodynamic transducer units may be used, for example transducer units of the capacitive type.

It is to be noted that U.S. Pat. No. 4,387,270 describes an arrangement which comprises an amplifier having its output coupled to a series arrangement of two impedances and a transducer unit. In this arrangement the voltage across one of the impedances is fed back to an input of the amplifier, but the object of this is to match the output impedance of the amplifier to the internal impedance of the transducer unit. However, this known arrangement is not intended for influencing the acoustic properties of a space.

An arrangement in accordance with an embodiment of the invention may be characterized further in that a second impedance for at least substantially compensating for the internal impedance of the transducer unit is arranged in series with the first impedance, the series arrangement of the first impedance and the second impedance being coupled between the first input terminal and the second input terminal of the amplifier.

As the second impedance compensates for the internal impedance of the transducer unit the impedance value of the second impedance and the gain factor of the amplifier for the signal applied to the first input terminal and the second input terminal and taken from the first output terminal and the second output terminal should be fixed.

If in this embodiment the acoustic properties of the arrangement are to be varied, this can be achieved only if the impedance value of the first impedance is variable. However, in that case it is not possible to cover the entire range from 100% reflecting to 100% absorbing.

However, this arrangement can provide a frequency independent reflection and absorption characteristic. Another arrangement in accordance with an embodiment of the invention, which also enables a frequency-independent reflection and absorption to be obtained, is characterized in that a second impedance which is chosen to at least substantially compensate for the internal impedance of the transducer unit, is arranged in series with the first impedance and the transducer unit. The second impedance is also coupled between a third input terminal and a fourth input terminal of the amplifier. If, in this embodiment, the acoustic properties of the device is to be variable, two degrees of freedom are available for this purpose. The impedance value of the first impedance and/or the gain factor of the amplifier for the signal applied to the first input terminal and the second input terminal and taken from the first output terminal and the second output terminal may then be varied. However, when a frequency-dependent absorption and reflection are required, this can be achieved if said gain factor is frequency dependent and/or if the impedance value of the second impedance is complex. It is obvious that, if desired, the frequency dependence may be varied.

This frequency-dependence of the reflection and the absorption coefficient may be necessary because the reverberation time in a space is sometimes smaller at higher frequencies than at lower frequencies. By constructing the arrangement in such a way that it is more reflecting for higher frequencies than for lower frequencies, a frequency-independent reverberation time can be obtained in the space.

An electro-acoustic system comprising a plurality of electro-acoustic arrangements in accordance with the invention may be characterized in that the system comprises control means for the remote control of the gain factors of the amplifiers for the signal applied to the first input terminal and the second input terminal and delivered to the first output terminal and the second output terminal and/or the impedance value of the first impedance. Such a system can be realized simply because it only requires signal lines over which the control signals may be applied for the remote control of the reflection coefficients of the arrangements.

BRIEF DESCRIPTION OF THE DRAWINGS

The invention will now be described in more detail, by way of example, with reference to the accompanying drawings in which identical parts bear the same reference numerals. In the drawings.

DESCRIPTION OF THE PREFERRED EMBODIMENTS

Figure 1:
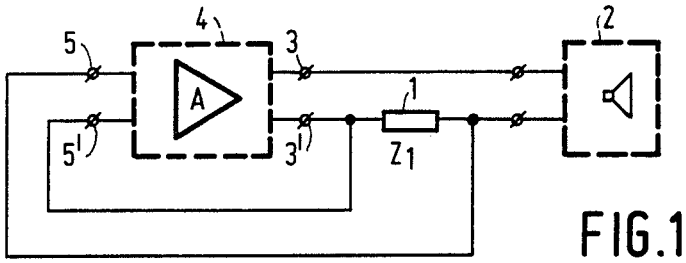
FIGS. 1 and 2 show an arrangement in accordance with the first embodiment of the invention.

FIG. 1 shows schematically an embodiment comprising a series arrangement of a transducer unit 2 and a first impedance 1 having an impedance value $Z_1$, which series arrangement is coupled to the output terminals 3, 3' of an amplifier 4. Further, the first impedance 1 is coupled to a first input terminal 5 and a second input terminal 5' of the amplifier 4. The gain factor A of the amplifier for the signal applied to the first input terminal 5 and the second input terminal 5' and delivered to the first output terminal 3 and the second output terminal 3' may be fixed or variable. The impedance value $Z_1$ of the first impedance 1 may also be fixed or variable.

Figure 2:
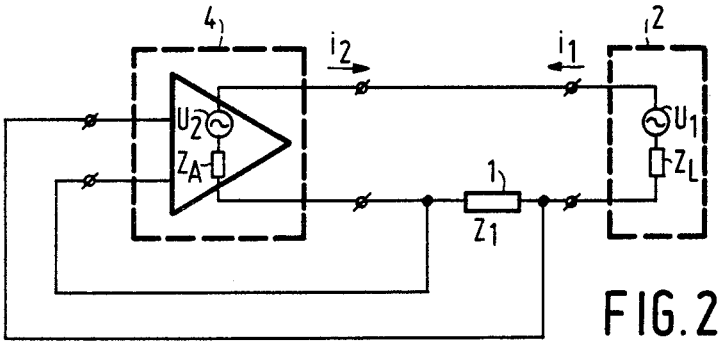

The acoustic behaviour of the arrangement shown in FIG. 1 will be described with reference to FIGS. 2 and 3. FIG. 2 shows the electrical circuit diagram of the arrangement in FIG. 1. The amplifier 4 is shown in more detail in FIG. 2, in which it is represented by a signal source $u_2$ having an internal impedance $Z_A$. The transducer unit 2 (since it also operates as a microphone) is represented by a signal source $u_1$ having an internal impedance $Z_L$.

The sources $u_1$ and $u_2$ produce the following currents in the series arrangement:

$$i_1 = \frac{u_1}{Z_A + Z_L + Z_1} \quad (1a)$$

$$i_2 = \frac{u_2}{Z_A + Z_L + Z_1} \quad (1b)$$

Although in the situation in which the transducer unit 2 functions as a microphone (as expressed by formula 1a) the internal impedance $Z_L$ of this unit has another value than in the situation in which the transducer unit 2 operates as a loudspeaker (as described by formula 1b), it has been assumed in the foregoing that these impedances are equal. This has been done merely to simplify the calculations. The resulting current $i_{tot}$ is now $$i_{tot} = i_2 - i_1 = \frac{u_2 - u_1}{Z_A + Z_L + Z_1} \quad (2)$$

The voltage produced across the impedance 1 by the current $i_{tot}$ is applied to the input terminals 5, 5' of the amplifier 4 and after amplification yields the voltage $u_2$, so that:

$$u_2 = AZ_1 i_{tot} \quad (3)$$

Inserting formule (3) into formula (2) yields:

$$\frac{i_{tot}}{u_1} = \frac{1}{-Z_{tot} + AZ_1} \quad (4)$$

where $Z_{tot} = Z_A + Z_L + Z_1$.

Figure 3A:
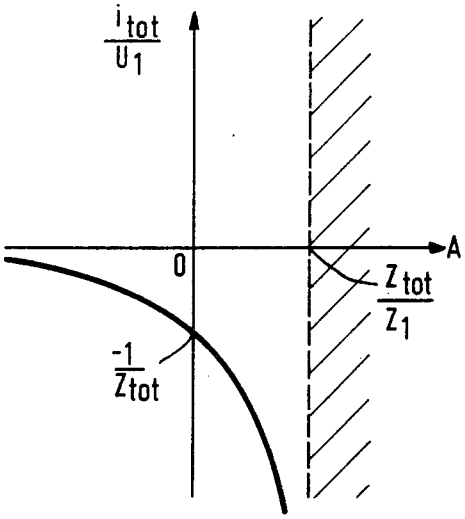
FIGS. 3*a* and 3*b* are two graphs in which the current $i_{tot}$ through the transducer unit has been plotted as a function of the gain factor A of the amplifier and as a function of the impedance value $Z_1$ of the first impedance, respectively.

In FIG. 3*a* $i_{tot}/u_1$ as expressed by formula (4) has been plotted as a function of the gain factor A. The function $i_{tot}/u_1$ is found to give a hyperbola having an asymptote for $A = Z_{tot}/Z_1$. Consequently, the arrangement is unstable for $A = Z_{tot}/Z_1$ (the current is very large). Therefore, the requirement $A \neq Z_{tot}/Z_1$ should be met. Moreover, it is required that $A < Z_{tot}/Z_1$. This follows from the requirement that the loop gain for the circuit should be smaller than 1. For $A > Z_{tot}/Z_1$ the arrangement will oscillate. In the graph of FIG. 3*a* this impermissible range for A is represented by the hatched area.

The following special cases may be derived from formula (4) and hence from the graph in FIG. 3*a*.

(a) Assume that A is very large and negative

In that case $i_{tot}$ is substantially equal to zero in conformity with formula (4). The current through the transducer unit is then substantially zero, which means that the diaphragm of the transducer is stationary. All the acoustic waves which are incident on the diaphragm of the transducer unit are reflected (substantially) fully by the transducer unit. As a result of the conversion of the incident acoustic waves the original current $i_1$ is cancelled (substantially wholly) by the amplifier 4. This is valid for all values of A in the range $A < 0$, in which case $i_{tot}$ is smaller than $i_1$ but has the same direction as $i_1$. In this entire range the amplifier 4 counteracts the current $i_1$ supplied by the transducer unit 2, the reflection coefficient decreasing and the absorption coefficient increasing as the absolute value of A decreases.

(b) Let A be slightly smaller than $Z_{tot}/Z_1$

According to formula (4) $i_{tot}$ is then very large and flows through the electric circuit of FIG. 2 in the direction of $i_1$. Now substantially total absorption is obtained. In the range $0 < A < Z_{tot}/Z_1$, i.e. where the gain factor A is positive, $i_{tot}$ is larger than $i_1$ and flows in the same direction as $i_1$. The amplifier 4 amplifies the current $i_1$ supplied by the transducer unit 2 as a result of the incident acoustic waves. In this range the absorption coefficient decreases and, consequently, the reflection coefficient increases as the value of A decreases.

(c) For $A = 0$ the electric circuit of FIG. 2 will behave as a passive network. The transducer unit now functions only as a microphone. It is obvious that this situation does not fall within the scope of the claims because in fact there is no longer an amplifier which amplifies or attenuates the signal.

Figure 3B:
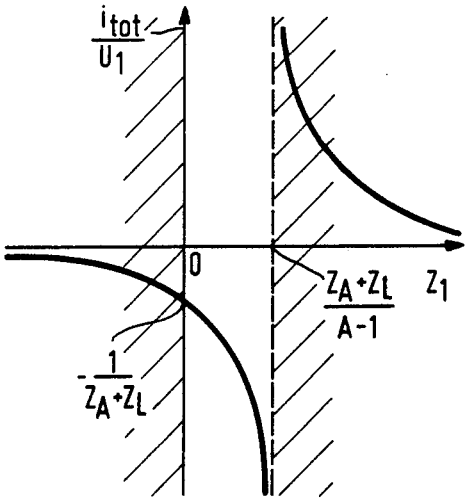

In FIG. 3*b* $i_{tot}/u_1$, as given by formula (4), has been plotted as a function of the impedance value $Z_1$. Now the function is also found to give a hyperbola. The asymptote is situated at $$Z_1 = \frac{Z_A - Z_L}{A - 1}.$$

If the asymptote should be situated in the right-hand half, the requirement $A - 1 > 0$ must be met. However, for reasons of stability the requirement $$Z_1 < \frac{Z_A + Z_L}{A - 1}$$

must be met. Further, it is obvious that $Z_1$ should be larger than zero. The impermissible range for $Z_1$ is represented by the hatched portions. Therefore, $Z_1$ should be situated in the range $$O < Z_1 < \frac{Z_A + Z_L}{A - 1}.$$

If $Z_1$ is variable there is only a limited range within which $Z_1$ may vary. If $Z_1$ is slightly smaller than $(Z_A + Z_L)/(A - 1)$ the arrangement provides substantially total absorption and it becomes less absorbing as the value of $Z_1$ decreases. Therefore, it will be evident from the foregoing that a specific setting of A and $Z_1$ results in a specific acoustic behaviour of the arrangement. Moreover, varying A and/or $Z_1$ (if possible) enables this acoustic behaviour, i.e. the reflection coefficient and the absorption coefficient of the arrangement, to be varied.

Figure 4:
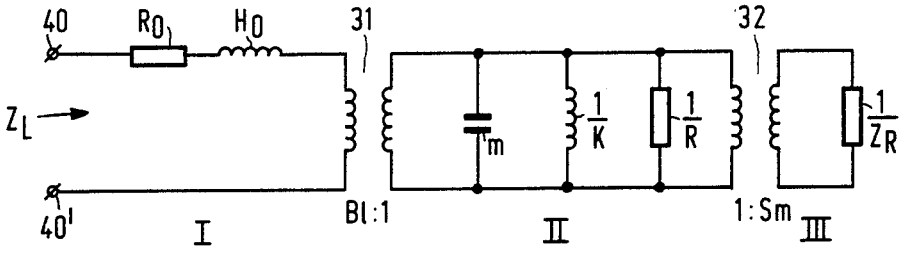
FIG. 4 is a mobility-type analogous circuit of a moving-coil loudspeaker.

Generally, $Z_{tot}$ in formula (4) is frequency-dependent because $Z_L$ is frequency-dependent. This will be illustrated by means of FIG. 4. FIG. 4 shows the mobility type analogous circuit for a moving-coil loudspeaker. The internal impedance $Z_L$ of the loudspeaker is the impedance seen at the terminals 40, 40'. The diagram comprises three parts. Part I is the electrical part, comprising the series arrangement of the voice-coil resistance $R_O$ and the voice-coil inductance $H_O$. Part I is coupled to part II, which is the equivalent diagram for the mechanical part of the transducer, via a transformer with a winding ratio B1:1. Part II comprises a parallel arrangement of a capacitance m, an inductance 1/k, and a resistance 1/R, which are the electrical analogues for the mass m, the suspension k and the mechanical damping R in the moving parts of the transducer, i.e. the diaphragm, the voice-coil former, and the voice coil. Via the transformer 32 having a winding ratio $1:S_m$ part II is coupled to part III, which is the acoustic part. This part only comprises the electrical analogue of the acoustic radiation impedance $Z_R$ experienced by the diaphragm of the transducer unit in the form of an impedance of the value $1/Z_R$.

The parameters in the winding ratios of the transformers 31 and 32 have the following meanings:

B=magnetic inductance in the air gap of the magnet system,

1=length of the voice-coil conductor, $S_m$=surface area of the diaphragm.

From FIG. 4 it is evident that $Z_L$ is frequency-dependent. This also applies to transducer units of, for example, the capacitive type.

The fact that $Z_L$ is frequency-dependent means that the reflection coefficient and the absorption coefficient of the arrangement may be frequency-dependent for a specific setting of A and $Z_1$. When an acoustic wave of a certain frequency is incident on the transducer unit the reflection and the absorption will therefore be different than when an acoustic wave of another frequency is incident. Moreover, the frequency-dependence will generally vary in the case of a variation A and/or $Z_1$.

Figure 5:
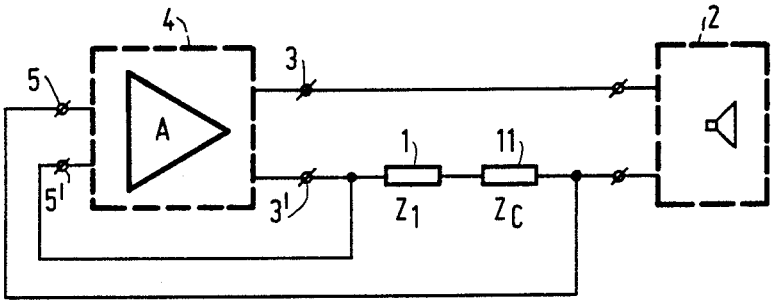
FIG. 5 shows a second embodiment.

The arrangement shown in FIG. 5 achieves a frequency-independent reflection and absorption. In the arrangement shown in FIG. 5 a second impedance 11 having an impedance value $Z_c$ is arranged in series with the first impedance 1. Moreover, the two impedances are arranged between the input terminals 5, 5'. The following formula can now be found in the same way as formula (4):

$$\frac{i_{tot}}{u_1} = \frac{1}{-Z_A - Z_L + (A-1)(Z_1 + Z_C)} \tag{5}$$

The second impedance 11 is intended to compensate for the (frequency-dependent) impedance $Z_L$ of the transducer unit 2. For this purpose it is assumed that $$(A-1)Z_C = Z_L \tag{6}$$

Inserting formula (6) in formula (5) yields $$\frac{i_{tot}}{u_1} = \frac{1}{-Z_A + (A-1)Z_1} \tag{7}$$

From the foregoing it follows that the gain factor A and the impedance value $Z_C$ are defined by formula (6). For a given value of A it is possible to determine $Z_C$ by means of formula (6) because $Z_1$ is known, see FIG. 4. Conversely: when $Z_C$ is given, A can be determined by means of formula (6). This means that in formula (7) only $Z_1$ may be varied, if desired. Moreover, it follows from formula (7) that if A is frequency-independent and $Z_1$ is real, (i.e. $Z_1$ is a resistor), the reflection coefficient and the absorption coefficient of the arrangement are frequency-independent. This is because the internal impedance $Z_A$ of the amplifier 4 is small and generally frequency-independent.

Figure 6:
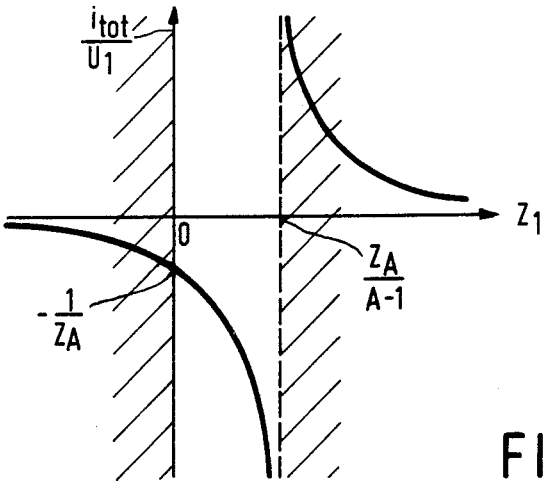
FIG. 6 is a graph in which the current $i_{tot}$ has been plotted as a function of $Z_1$.

In FIG. 6 $i_{tot}/u_1$ of formula (7) has been plotted as a function of impedance $Z_1$. A comparison of the graphs in FIG. 3*b* and FIG. 6 shows that they correspond to a large extent. The graph in FIG. 6 can be derived from the graph of FIG. 3*b* if $Z_1$ is assumed to be zero. As in this case $Z_1$ can be varied only in the range $0<Z_1<(-Z_A/A-1)$ (A is fixed because of formula (6)), the arrangement has only a limited use. For example, in the same way as was stated with reference to FIG. 3*b*, it is not possible to obtain a situation in which the arrangement provides (substantially) total reflection. This is because $Z_1$ cannot be smaller than zero.

Figure 7:
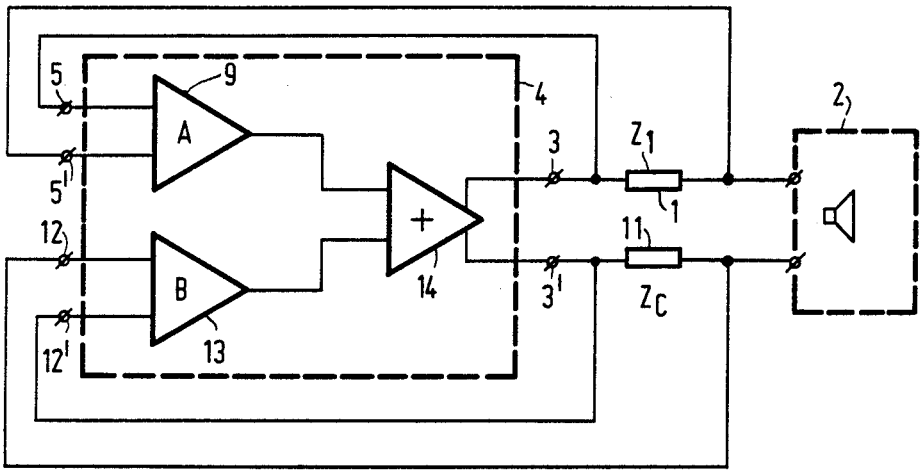
FIG. 7 shows a third embodiment.

The arrangement shown in FIG. 7 is capable of covering the entire range from (substantially) total reflection to (substantially) total absorption while maintaining a frequency-independent reflection and absorption.

Now only the first impedance 1 is coupled to the first input terminal 5 and the second input terminal 5' of the amplifier 4. The second impedance 11 is coupled to a third input terminal 12 and a fourth input terminal 12' of the amplifier 4. In addition to the amplifier stage 9, which amplifies the signal applied to the first input terminal 5 (and the second input terminal 5' and taken from the first out terminal 3 and the second output terminal 3') by the said gain factor A, the amplifier 4 comprises an amplifier stage 13 and a signal-combination unit 14. The amplifier stage 13 amplifies the signal applied to the third input terminal 12 and the fourth input terminal 12' (and taken from the output terminals 3', 3) by a gain factor B. The signal combination unit 14 serves to combine the output signals of the amplifier stages 9 and 13. Using a similar method of calculation as set forth with reference to FIG. 2, it is found that $$\frac{i_{tot}}{u_1} = \frac{1}{-Z_A - Z_L + (A-1)Z_1 + (B-1)Z_C}. \tag{8}$$

The second impedance 11 is again intended to compensate for the internal impedance $Z_L$ of the transducer unit 2. This means that the requirement:

$$(B-1)Z_C = Z_L \tag{9}$$

must be met. Inserting formula (9) into formula (8) yields:

$$\frac{i_{tot}}{u_1} = \frac{1}{-Z_A + (A-1)Z_1} \tag{10}$$

The gain factor B of the amplifier 4 for the signal applied to the third input terminal 12 and the fourth input terminal 12' and taken from the first output terminal 3 and second output terminal 3', and the impedance value $Z_C$ of the second impedance should therefore comply with formula (9). This provides an at least substantial impedance $Z_L$ of the transducer. The gain factor A for the signal applied to the first input terminal 5 and the second input terminal 5' and taken from the first output terminal 3 and the second output terminal 3', and the impedance value $Z_1$ of the first impedance 1 can now be selected freely and both determine the acoustic behaviour of the arrangement in conformity with formula (10). Moreover, if desired, both quantities may be varied. Again it is found that if A is frequency-independent and $Z_1$ is real (a resistor) the reflection and absorption are frequency-independent. In addition, when A and/or $Z_1$ is (are) varied, it is found that the frequency-independence of the absorption and reflection is maintained.

Figure 8A:
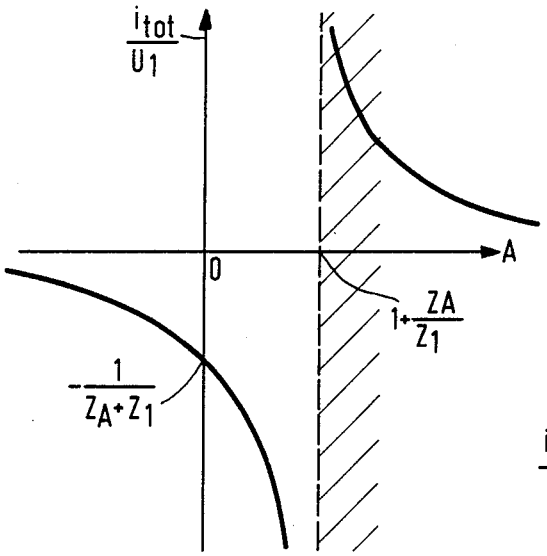
FIGS. 8*a* through 8*c* are three graphs in which the current $i_{tot}$ has been plotted as a function of A, as a function of $Z_1$ (for a specific $A_1$ for which $A_1-1>0$), and as a function of $Z_1$ (for a specific $A_2$ for which $A_2-1>0$), respectively.

The operation of the arrangement shown in FIG. 7 will now be explained with reference to the graphs in FIG. 8. FIG. 8*a* shows the graph representing $i_{tot}/u_1$, as expressed by formula (10), as a function of the gain factor A. The graph bears a resemblance to the graph in FIG. 3*a*. The asymptote is situated at $A=1+(Z_A/Z_1)$. In order to preclude instabilities in the arrangement, the requirement $A<1+(Z_A/Z_1)$ must be met. The impermissible range $A \geqq 1+(Z_A/Z_1)$ is represented by the hatched portion in FIG. 8a. A variation of A from a point slightly less than $1+(Z_A/Z_1)$ (through $A=0$) to a very large and negative value of A causes a variation of the acoustic properties of the arrangement from substantially total absorption to substantially total reflection.

Figure 8B:
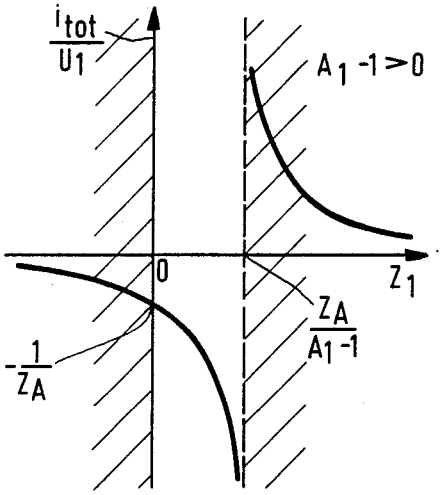
Figure 8C:
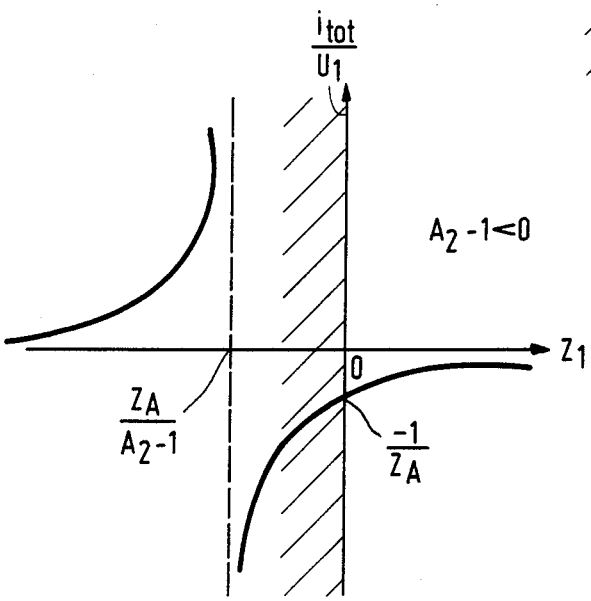

FIGS. 8b and 8c show graphs of $i_{tot}/u_1$, as expressed by formula (10), as a function of $Z_1$, namely for a fixed value of $A_1$ for which $A_1-1>0$ and for a fixed value of $A_2$ for which $A_2-1<0$, respectively.

FIG. 8b bears a strong resemblance to the graph in FIG. 3b. In the present case $Z_1$ can be situated only in the range $0<Z_1<(Z_A)/A_1-1)$. Again the impermissible range is represented by a hatch portion. Varying $Z_1$ from slightly smaller than $(Z_A/A_1-1)$ to $Z_1=0$ causes the acoustic properties of the arrangement to change from substantially totally absorbing to less absorbing and more reflecting. Again, the situation of substantially total reflection cannot be attained.

As already stated in the foregoing, FIG. 8b relates to a situation in which A is fixed and, moreover, $A-1>0$. FIG. 8c illustrates the situation for which A is fixed and $A-1<0$. It is obvious that the requirement $Z_1>0$ should be met. Again, the impermissible range for $Z_1 \leqq 0$ is represented by the hatched portion. In the present case a variation of $Z_1$ from 0 to a larger value causes the acoustic properties of the arrangement to vary from partly reflecting to substantially totally reflecting. The situation of substantially total absorption cannot be obtained in this case.

A combination of the graphs of FIGS. 8b and 8c enables the entire range from substantially total absorption to substantially total reflection to be realized. For this purpose, the arrangement in FIG. 7 comprises switching means by means of which the gain factor A of the amplifier stage 9 is switchable from a first value $A_1$, for which $A_1-1>0$, to a second value $A_2$, for which $A_2-1<0$.

If the gain factor of the amplifier stage 9 is $A_1$ the acoustic behaviour of the arrangement will vary from totally absorbing to less absorbing by varying $Z_1$ from $(Z_A/A_1-1)$ to 0. This is the situation illustrated by the graph in FIG. 8b. If $Z_1=0$ is reached, the gain factor is switched over from $A_1$ to $A_2$. Subsequently, $Z_1$ is increased and the acoustic behaviour of the arrangement changes from less reflecting to substantially totally reflecting. Now the situation in the graph of FIG. 8c is obtained. Moreover, if $A_2=2-A_1$, the transition from one graph to the other is smooth. This means that there is no discontinuity for $Z_1=0$.

If A and $Z_1$ are frequency-independent, the reflection and the absorption of the arrangement are also frequency-independent. This follows directly from formula (10). Obviously, it is also possible to obtain a specific frequency-dependence by making A frequency-dependent and/or $Z_1$ complex.

Figure 9:
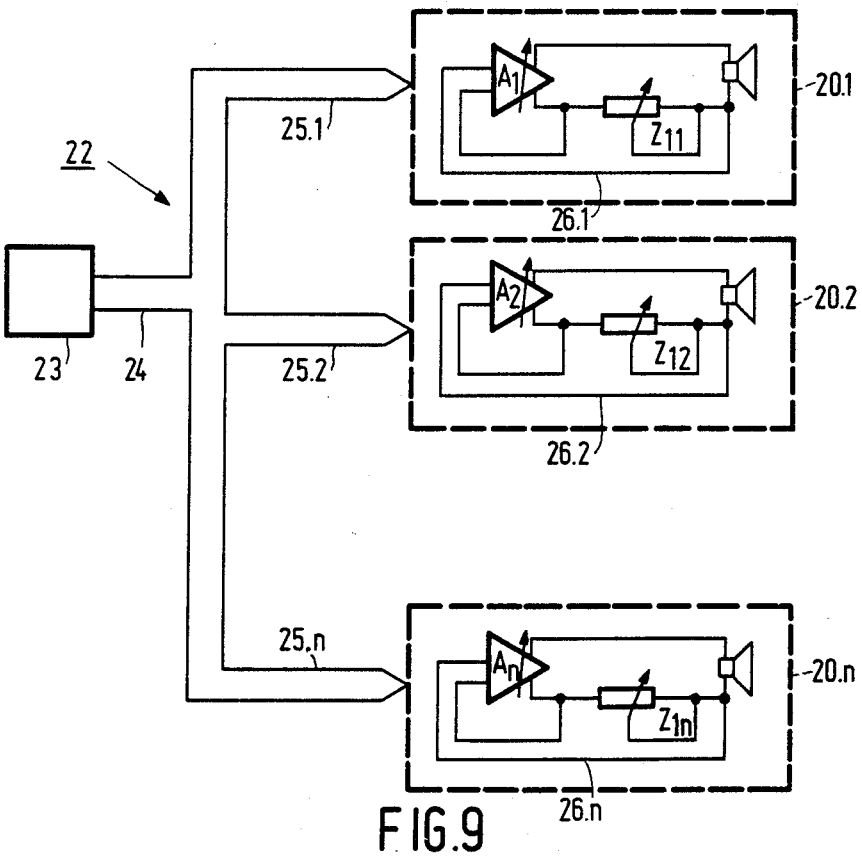
FIG. 9 shows an example of an electro-acoustic system comprising a plurality of arrangements in accordance with the invention.

FIG. 9 shows an electro-acoustic system comprising a plurality of arrangements 20.1 to 20.n. The arrangements may be as shown in FIGS. 1, 5 or 7. FIG. 9 shows arrangements as described with reference to FIG. 1. The system comprises means 22 for the remote control of the gain factors $A_1$ to $A_n$ of the amplifiers and/or the impedance values $Z_{11}$ to $Z_{1n}$ of the first impedances in the arrangements. The means 22 comprise a central control unit 23. Via the control lines 24 and 25.1 to 25.n over which the control signals for controlling the gain factors and/or the impedance values are transmitted, the control unit is coupled to the arrangements 20.1 to 20.n. The impedance values may be adjusted, for example, by means of the wipers of potentiometers which constitute the first impedances. Alternatively, the wipers may be coupled directly to the lines 26.1 to 26.n. In that case the impedance values with which the amplifiers are loaded remains constant. In a space, for example a concert hall, equipped with such a system the acoustic properties of such a hall, for example the reverberation time, can be adjusted and, if required, changed very simply.

It is to be noted that the invention is not limited to the arrangements and the system as described with reference to FIGS. 1 to 9. Arrangements and systems which differ from the embodiments described with respect to points which do not relate to the inventive idea also fall within the scope of the invention.

What is claimed is:

1. An electro-acoustic apparatus comprising: an audio amplifier having first and second signal input terminals and first and second signal output terminals, an electro-acoustic transducer unit which, in normal operation of the electro-acoustic apparatus, operates as both a loudspeaker and a microphone for the electro-acoustic apparatus, a first impedance, means connecting the first impedance and the transducer unit in series circuit to said first and second amplifier output terminals, and means coupling said amplifier first and second input terminals across said first impedance so that a signal developed across said first impedance serves as the sole input to said amplifier whereby the electro-acoustic apparatus can alter at least one acoustic property of a space as a function of the amplifier gain and/or the impedance value of said first impedance.

2. An electro-acoustic apparatus as claimed in claim 1 wherein the gain factor of the amplifier is frequency-dependent.

3. An electro-acoustic apparatus as claimed in claim 1 wherein the impedance value of the first impedance and the gain factor of the amplifier is variable so as to adjust to a desired value the reflection and absorption characteristic of a space in which the electro-acoustic apparatus is to be operative.

4. An electro-acoustic apparatus as claimed in claim 1 wherein the gain factor A of the amplifier satisfies the following relationship: $A<Z_{tot}/Z_1$ where $Z_{tot}=Z_A+Z_L+Z_1$ and $Z_A$, $Z_L$ and $Z_1$ are the impedance values of the amplifier internal impedance, the internal impedance of the transducer unit and the first impedance, respectively.

5. An electro-acoustic apparatus as claimed in claim 4 wherein for values of A between 0 and $Z_{tot}/Z_1$ the absorption coefficient decreases and the reflection coefficient increases as the value of A decreases.

6. An electro-acoustic apparatus as claimed in claim 1 further comprising a second impedance connected in said series circuit with the first impedance and the transducer unit, the impedance value ($Z_C$) of the second impedance being chosen so as to compensate a frequency-dependent impedance characteristic of the transducer unit, and wherein the following relationship is satisfied: $(A-1)Z_C=Z_L$, where A is the gain factor of the amplifier and $Z_L$ is the internal impedance of the transducer unit.

7. An electro-acoustic apparatus as claimed in claim 6 wherein the impedance $Z_1$ of the first impedance is variable only between the values 0 and $Z_A/(A-1)$, where $Z_A$ is the internal impedance value of the amplifier and A is the amplifier gain factor.

8. An electro-acoustic apparatus as claimed in claim 1 further comprising a second impedance connected in said series circuit with the first impedance and the transducer unit, and wherein the audio amplifier comprises a first amplifier unit having said first and second input terminals coupled across said first impedance and a second amplifier unit having third and foruth input terminals coupled across the second impedance, the impedance value $Z_C$ of the second impedance being chosen to compensate the internal impedance $Z_L$ of the transducer unit thereby to produce a frequency-independent reflection and absorption characteristic for the electro-acoustic apparatus.

9. An electro-acoustic apparatus as claimed in claim 8 wherein the first and second amplifier units have gain factors of A and B, respectively, and wherein the following relationship is satisfied: $(B-1)Z_C=Z_L$.

10. An electro-acoustic apparatus as claimed in claim 8 wherein the first impedance comprises a resistor and the first amplifier unit has a frequency-independent gain factor A, and wherein the first impedance and/or the gain factor A are variable and the electro-acoustic apparatus provides a frequency-independent absorption and reflection characteristic for the different values of impedance $Z_1$ of the first impedance and/or the different values of the gain factor A.

11. An electro-acoustic apparatus as claimed in claim 8, further comprising means for combining output signals of the first and second amplifier units and coupling same to said first and second amplifier output terminals.

12. An electro-acoustic apparatus as claimed in claim 1, wherein the transducer unit exhibits a frequency dependent impedance characteristic, said apparatus further comprising a second impedance, wherein said connecting means connects the second impedance in series circuit with the first impedance and the transducer unit to said amplifier first and second output terminals and said coupling means couples the amplifier first and second input terminals across the series arrangement of the first and second impedances, said second impedance having an impedance characteristic to substantially compensate for the impedance characteristic of the transducer unit whereby the apparatus achieves a frequency-independent reflection coefficient and absorption coefficient.

13. An electro-acoustic apparatus as claimed in claim 1, wherein the impedance of the first impedance and/or the amplifier gain factor is variable and said apparatus is adapted to be located in a space so that the loudspeaker receives a significant amount of acoustic energy from the space so as to operate as a microphone to develop a signal voltage across said first impedance, said developed signal voltage being applied via the coupling means as an input signal to the first and second input terminals of the amplifier.

14. An electro-acoustic apparatus as claimed in claim 1 wherein the impedance value $Z_1$ of the first impedance satisfies the relationship $0<Z_1<(Z_Z+Z_L)/(A-1)$ where $Z_A$ and $Z_L$ are the internal impedance value of the amplifier and the internal impedance value of the transducer unit, respectively, and A is the gain factor of the amplifier.

15. An electro-acoustic apparatus as claimed in claim 1 further comprising a second impedance connected in said series circuit with the first impedance and the transducer unit, said transducer unit exhibiting a frequency-dependent impedance characteristic, and wherein the impedance value ($Z_C$) of the second impedance is chosen so as to compensate said frequency-dependent impedance of the transducer unit thereby to produce a frequency-independent reflection and absorption characteristic for the electro-acoustic apparatus.

16. An electro-acoustic system for influencing the acoustic properties of a space comprising: a plurality of electro-acoustic arrangements, each arrangement comprising an electro-acoustic transducer unit connected in series with a first impedance, means coupling the series arrangement of the first impedance and the transducer unit to first and second output terminals of an amplifier, means connecting the first impedance between first and second input terminals of the amplifier, the impedance value of the first impedance and/or the gain factor of the amplifier, for a signal applied to the first and second input terminals and delivered to the first and second output terminals, being variable, and control means for the remote control of the gain factors of the amplifiers and/or the impedance value of the first impedances of the electro-acoustic arrangements.

17. An electro-acoustic system as claimed in claim 16, characterized in that the gain factor of the amplifier for a signal applied to the first input terminal and the second input terminal and taken from the first output terminal and the second output terminal is frequency-dependent.

18. An electro-acoustic system claimed in claim 16, characterized in that each said arrangement comprises a second impedance having an impedance value which at least substantially compensates for the internal impedance of the transducer unit and which is connected in series with the first impedance, the series arrangement of the first impedance and the second impedance being coupled between the first input terminal and the second input terminal of the amplifier.

19. An electro-acoustic system as claimed in claim 16, characterized in that each said arrangement comprises a second impedance having an impedance value for at least substantially compensating for the internal impedance of the transducer unit and which is connected in series with the first impedance and the transducer unit, and means coupling the second impedance between a third input terminal and a fourth input terminal of the amplifier.

20. An electro-acoustic arrangement for influencing the acoustic properties of a space comprising: an electro-acoustic transducer unit, an amplifier having first and second input terminals and first and second output terminals, a first impedance, a second impedance, means coupling the first and second impedances and the transducer unit in a series arrangement to the first and second output terminals, characterized in that the second impedance has an impedance value which at least substantially compensates for the internal impedance of the transducer unit, and means excluding the transducer unit for coupling the series arrangement of the first impedance and the second impedance between the first input terminal and the second input terminal of the amplifier.

21. An electro-acoustic arrangement as claimed in claim 20, characterized in that the impedance value of the first impedance is variable.

22. An electro-acoustic arrangement as claimed in claim 20 wherein the gain factor of the amplifier is frequency-dependent and said transducer unit comprises the only source of electric signal for the amplifier.

23. An electro-acoustic arrangement for influencing the acoustic properties of a space comprising: an electro-acoustic transducer unit, an amplifier having first and second input terminals and first and second output terminals, a first impedance, a second impedance, means coupling the first and second impedances and the transducer unit in a series arrangement to the first and second output terminals, characterized in that the second impedance has an impedance value for at least substantially compensating for the internal impedance of the transducer unit, second means coupling the first impedance between the first and second input terminals of the amplifier, and third means coupling the second impedance between a third input terminal and a fourth input terminal of the amplifier.

* * * * *